United States Patent [19]

Emmel et al.

[11] Patent Number: 4,742,913

[45] Date of Patent: May 10, 1988

[54] DISPENSER FOR PREDETERMINED LENGTHS OF TAPE

[75] Inventors: John J. Emmel, Blaine; Wayne K. Darvell, North St. Paul; Wayne K. Dunshee, Maplewood, all of Minn.

[73] Assignee: Minnesota Mining and Manufacturing Company, Saint Paul, Minn.

[21] Appl. No.: 862,013

[22] Filed: May 12, 1986

[51] Int. Cl.[4] ..... B65D 73/00

[52] U.S. Cl. ..... 206/460; 206/447; 206/472; 206/476; 206/804; 206/813

[58] Field of Search ..... 206/37, 39, 39.3–39.7, 206/104, 103, 106, 110, 113, 118, 447, 450, 460, 472, 476, 526, 804, 813, 815, 816, 820

[56] References Cited

U.S. PATENT DOCUMENTS

| | | | |
|---|---|---|---|
| 859,000 | 7/1907 | Marsh | 206/39 |
| 1,931,609 | 10/1933 | Johnson | 206/39.5 |
| 2,170,147 | 8/1939 | Lane | 206/447 |
| 2,248,317 | 7/1941 | Van Cleef | 206/447 |
| 2,249,424 | 7/1941 | Hanington | 206/813 |
| 2,279,893 | 4/1942 | Ross et al. | 206/103 |
| 2,547,252 | 4/1951 | Bouchard et al. | 206/104 |
| 3,056,154 | 10/1962 | Neal | 206/447 |
| 3,583,358 | 3/1969 | Hanson, Jr. | 206/447 |
| 3,690,449 | 9/1972 | Seldin | 206/113 |
| 3,951,258 | 4/1976 | Burdick | 206/118 |
| 4,006,819 | 2/1977 | Elliott | 206/104 |
| 4,016,973 | 4/1977 | Blake | 206/118 |
| 4,077,513 | 3/1978 | Ferrara, Jr. | 206/106 |
| 4,355,720 | 10/1982 | Hofberg et al. | 206/460 |
| 4,558,888 | 12/1985 | Hanson et al. | 206/813 |
| 4,570,797 | 2/1986 | Weinman | 206/460 |

FOREIGN PATENT DOCUMENTS

| | | | |
|---|---|---|---|
| 641048 | 8/1950 | United Kingdom | 206/450 |

*Primary Examiner*—David T. Fidei

*Attorney, Agent, or Firm*—Donald M. Sell; James A. Smith; John C. Barnes

[57] ABSTRACT

A dispenser package for a stack of strips of pressure-sensitive adhesive tape. Each strip is formed with a tab at one end thereof and the strips of tape are aligned in the stack. The package comprises a support member supporting the stack of strips throughout their length and a cover portion which is positioned above the stack of strips and joined to the support member at one end and the cover is provided with an edge portion at the other end extending transversely of the stack at a position adjacent the tabs. The cover is formed of a flexible material to bow between its ends as the top strip is separated from the stack to hold the strip nearly perpendicular to the stack as it is peeled from the stack.

8 Claims, 3 Drawing Sheets

DISPENSER FOR PREDETERMINED LENGTHS OF TAPE

BACKGROUND OF THE INVENTION

1. Field of the Invention

This invention relates to a dispenser for predetermined lengths of tape which are formed in a stack, and in one aspect to a dispenser for precut lengths of pressure-sensitive adhesive tape disposed in the stack with each strip of tape having a tab at one end which permits the dispensing of a strip of tape ready for application.

2. Description of the Prior Art

Pads or stacks of predetermined lengths of tape are known in the prior art. Such stacks of tape known to applicants however are adapted for use as lint removers from garments and not as a supply of predetermined lengths of presssure-sensitive adhesive tape for use in a manner similar to that of tape dispensed from a roll. Such stacks of tape adapted for use as lint removers include U.S. Pat. Nos. 2,528,602; 2,724,847; and 3,373,457. These patents all show a stack of pressure-sensitive tape supported in a package in such a way that stripping a liner from the top sheet will expose the adhesive coated surface of the adjacent sheet, and the container may be folded or assembled in such a manner that the same serves as a handle for holding the pad of sheets to permit the same to be brought into contact with different areas of the garment to remove lint therefrom. In each of these prior devices the package provides a support for the pad. When the adhesive coated sheets are removed they are ready for disposal and how they are removed is of little importance.

Another patent, U.S. Pat. No. 2,574,152, discloses a pad of sheets of pressure-sensitive adhesive material having an uncoated or nonadhesive nontacky surface adjacent at least one edge of each sheet. The sheets are adapted for use in mounting photographs. This patent however fails to teach a support for the sheets which will facilitate the separation of the sheets and avoid having the sheets curl or fold after they are separated which is a common problem encountered with strips of tape being peeled from a stack.

When separating a strip of tape from a stack of strips, the peeling of the strip of tape from the stack generally causes a curl to set in the tape backing. Thus, after the tape is peeled from the stack it will curl, roll or fold back upon itself, causing the adhesive to stick to other adhesive coated areas or to the backing of the tape, making it difficult to apply the dispensed strip onto a receptor surface. The tape must first be unwound and grasped in two hands and applied to the surface and then wiped in place.

The present invention provides a package of predetermined lengths of tape each formed with a tab at one end to permit the individual strips to be readily separated and removed from the stack. The package of the present invention affords removal of a strip of tape with the strip of tape being maintained in a generally straight flat condition ready for application. The removal of one strip from the stack is equivalent to the removal of a strip of tape from a roll.

The present invention provides a dispenser package for tape strips designed so the tape strips are removed from a stack of strips at an angle which is more nearly perpendicular to the stack of tape strips than parallel to the strips in a stack. The present invention thus provides a dispensing package for a stack of strips having a predetermined length and width and aligned in the stack.

SUMMARY OF THE INVENTION

The present invention is directed to a novel package of pressure-sensitive tape. The package of the present invention comprises a stack of strips of pressure-sensitive adhesive tape disposed one upon the other in the stack. Each strip is preferably formed at one end with a tab or the like permitting facile separation of one strip of tape from the adjacent strips of tape. The stack of tape strips are positioned in a dispenser package. The dispenser package provides a support member for the stack of strips and a flexible cover which is positioned above and in contact with the stack of strips. The cover has a transverse edge adjacent one end which edge is positioned transverse to the stack of strips and is spaced from the tab or one end of the top strip of tape. The other end of the cover is connected to the support member, which is rigid or flexible. The cover is formed of resilient material having a thickness such that it can flex into a bow between said transverse edge and the other or opposite end connected to the support member and return to its normal position overlaying and generally parallel with the top of the stack of strips. The cover extends from the position at which it is connected to the support member to a position over the pad with the transverse edge positioned adjacent the tabs on the strips of tape but not covering the tabs. The exposed portion of the tab permits lifting one tab on the top strip of tape causing the tape to engage the transverse edge of the cover. As the tape strip is peeled from the stack the cover will bend into an arc between its ends. As the tape strip is peeled, the cover maintains the tape strip at an angle of about 90° to the support member. When the strip is removed, the cover will have sufficient memory to return to its generally planar position on the top of the stack of strips.

The cover, at the end adjacent the transverse edge, may have means for restricting the separation of the free end of the cover or the transverse edge of the cover from the upper surface of the support member and the stack of strips. Such means for restricting the separation of the free end of the cover includes an extended end of the cover which extends from at least one end of the transverse edge outwardly thereof and inwardly to form a hook which can be placed in a position contacting the surface of the support member opposite the surface supporting the stack of strips. The support member and its cover may be formed from a single sheet of material provided with a fold line defining a hinge therebetween.

The dispenser has a support surface for the stack of strips over which the cover is positioned. The cover has a slotted opening which will receive the stack of strips and the support member to restrict separation of the free end of the cover from the stack and the support members. In this embodiment one wall of the slotted opening provides the transverse edge and the opening provides the means for restricting the separation of the free end of the cover from the support member during peeling separation of the top strip of tape from the stack.

BRIEF DESCRIPTION OF THE DRAWING

The present invention will be further described with reference to the accompanying drawing wherein.

DESCRIPTION OF THE PREFERRED EMBODIMENTS

Figure 4:
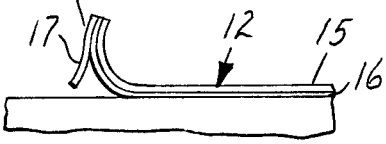
FIG. 4 is a detailed view of one end of a strip of tape showing a tab positioned on the adhesive surface of the tape.

The present invention provides a package for a stack of strips of tape of a predetermined width and length. The dispenser package is generally designated by the reference numeral 10 and comprises a stack 11 of strips of pressure-sensitive adhesive tape 12 with the strips of tape aligned in the stack. Each strip 12 is provided with a tab 13 at one end permitting facile separation of each strip of tape from the adjacent strips in the stack. Each strip of tape 12 (see FIG. 4) comprises a backing 15 having on one surface thereof a coating 16 of pressure-sensitive adhesive. If necessary to obtain separation of one strip from another the backing 15 has a release coating (not shown), on the surface opposite the adhesive, for reducing the adhesion of the adhesive to the opposite surface of the backing. This coating is called a low adhesion backsize which permits separation of the strips of tape. At one end of each strip of tape 12 is a tab 13 or the like to permit separation of the strips, e.g. adhesive free ends, removable liner portions, folded tape ends, etc. The tab 13 illustrated is formed by a strip 17 of paper or polymeric material adhered to the adhesive coating 16 adjacent the end of the strip 12. The stack 11 is positioned over a support surface of a packaging strip 20.

Figure 1:
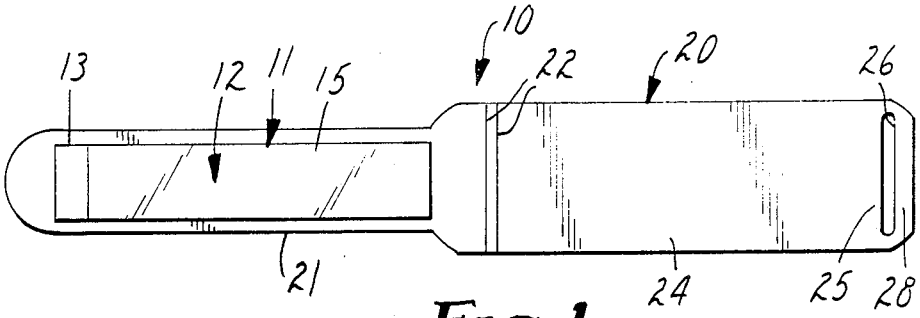
FIG. 1 is a plan view of the package with the cover removed from its normal position above the stack of strips.
Figure 2:
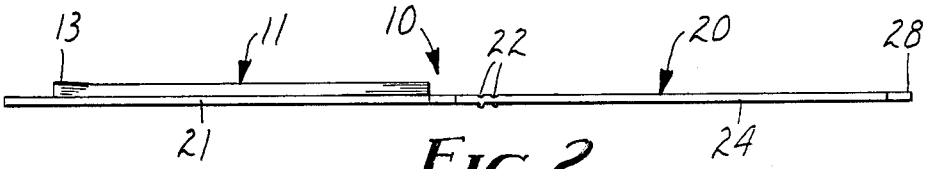
FIG. 2 is a side elevational view of the package as seen in FIG. 1.

The strip 20 is cut from a piece of flexible material and has one end portion 21 defining a support member for the stack 11. The support surface supports the entire lower strip of tape of the stack of strips and preferably extends beyond the ends and edges of the stack, as illustrated in FIG. 1. The strip 20 is provided with fold lines 22 which define hinge means and separates the support member 21 from a flap forming a cover portion 24 of the package. Cover 24 is normally positioned above the stack 11 of strips of tape 12. The cover 24 has, adjacent its free end, a transverse edge 25 which extends transversely of the strip 20 and is adapted to be positioned transversely of the stack 11 of strips of tape 12 and in contact with the top strip of tape. The cover 24 has a length to position the transverse edge 25 at a position adjacent the ends of the strips of tape having the tab 13 and is spaced preferably slightly from the tabs in its normal position. As illustrated in FIG. 1, the transverse edge 25 is one edge of a traverse slot 26 which is formed in the free end 28 of the cover 24. The slot 26 has a length sufficient to receive the free end of the support member 21 and a width sufficient to receive the support member and the stack 11 of strips of tape. The slot 26 defines, at the end of the cover 24, means for restricting the separation of the free end 28 of the cover 24 from the support member and the stack of strips such that the transverse edge 25 will remain in contact with the upper strip of tape 12 as the same is being peeled from the stack.

Figure 3:
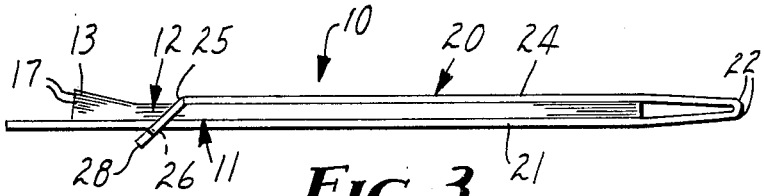
FIG. 3 is a side elevational view of the package of the present invention with the cover in its normal position over the stack of strips.

As illustrated in FIG. 3, the end 28 of the cover 24 is disposed below the side of the support member 21 opposite the support surface and the stack 11 of tape strips 12 and the transverse edge 25 thereof is positioned above the stack of strips adjacent the tabs 13 but leaves at least a portion of each tab exposed.

Figure 5:
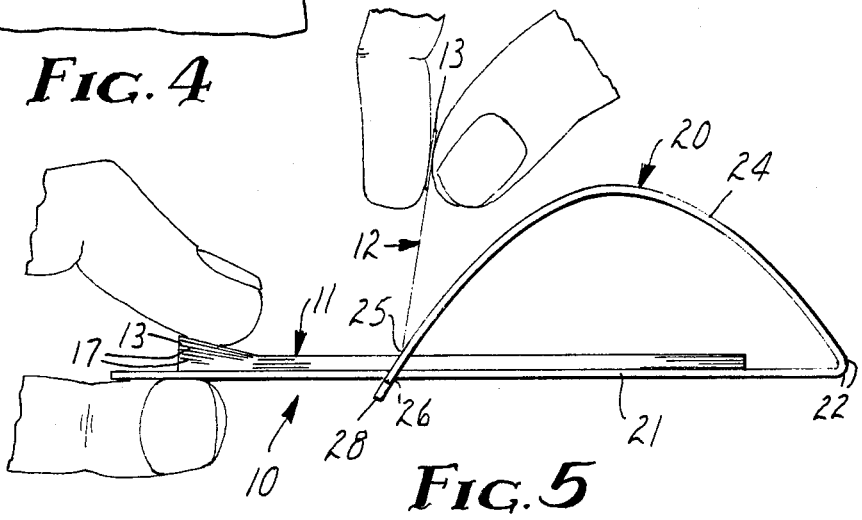
FIG. 5 is a side elevational view showing the dispensing action of the package as a strip of tape is dispensed from the stack.

To separate the upper strip 12 of tape from the stack, the tab 13 is grasped between the thumb and forefinger of one hand and the support and the end of the stack adjacent the tab 13 are supported between the thumb and forefinger of the other hand. The tab end of the top strip 12 is then moved upwardly from the stack and in doing so, the cover 24 forms a bow, as illustrated in FIG. 5, between the edge 25 and the opposite end of the cover where it is joined to the support member 21. Thus, as the tape strip 12 is peeled from the stack the tape maintains an angle with respect to the stack which is more nearly 90 degrees than 180 degrees or parallel to the stack of strips as the same is separated therefrom.

As the strip of tape is removed and is peeled from the stack at an angle of nearly 90 degrees the tape backing undergoes considerably less bending stress, which would tend to cause the tape to curl, such that when the end of the strip is peeled free of the stack the tape will not roll or curl upon itself. In other words, the tape strip after removal is substantially straight, making it less difficult to adhere the separated tape to a receptor surface.

Figure 6:
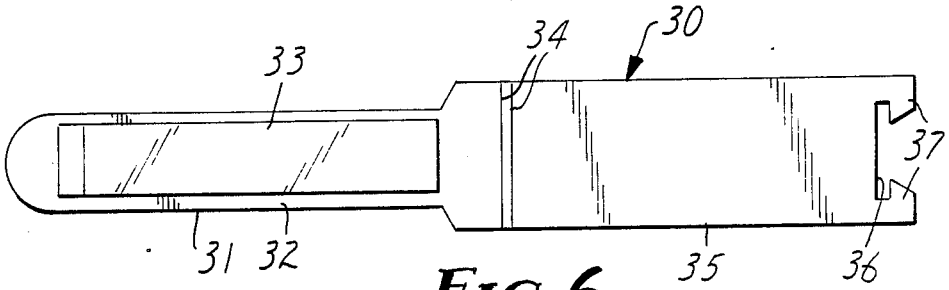
FIG. 6 is a plan view of a second embodiment of a package constructed according to the present invention.
Figure 7:
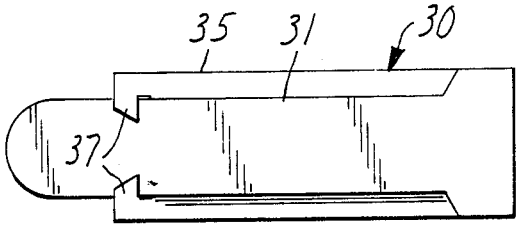
FIG. 7 is a bottom view of a package according to the second embodiment.

Referring now to FIGS. 6 and 7 a second embodiment of the dispenser is illustrated. In this embodiment a strip 30 comprises a narrow support member 31 having a support surface 32 for a stack 33 of strips of tape. The support member 31 is joined by a fold line 34, or fold lines, to a cover portion 35 which at its distal or free end is formed with a notch which defines a transverse edge 36 and a pair of hooks 37 which extend transversely from the edge 36 and outwardly therefrom to terminate in projections which are adapted to engage the side of the support member 31 opposite the stack 33 of tape strips, as illustrated in the bottom view of the completed package, see FIG. 7.

Figure 8:
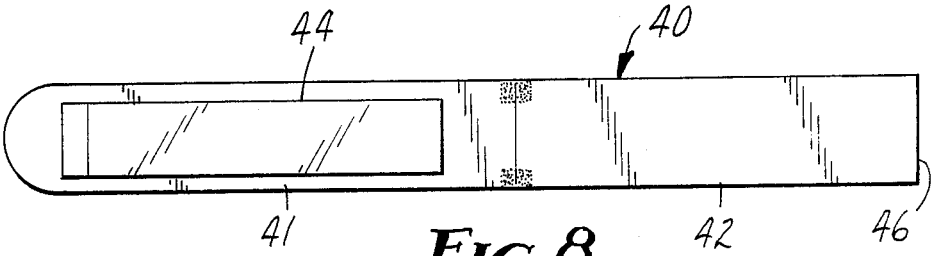
FIG. 8 is a top plan view of a further embodiment of a package according to the present invention.
Figure 9:
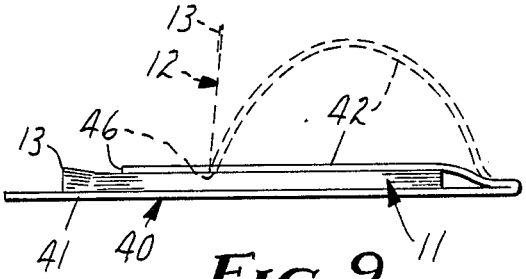
FIG. 9 is a side elevational view of a package according to FIG. 8 showing the cover also in dotted lines to represent the position during dispensing of a strip of tape.

FIG. 8 shows a further modification of the present invention. In FIG. 8 a package strip 40 comprises a support member 41 and a cover portion 42 joined by a hinge-like fold line or the cover portion may be joined to one end of the support member by a staple or by glueing the adjacent abutting end of the support member 41 and the cover 42 such that in its normal position the cover would lie flat on the upper surface of the top strip of tape 12 in the stack 44. The embodiment illustrated in FIG. 8 differs from that illustrated in FIGS. 1 through 6 also in that it does not include means for restricting the separation of the free end of the cover from the upper surface of the stack 44 of strips of tape. The cover does terminate in a transversely extending edge 46 which is normally positioned adjacent but spaced from the ends of the strips of tape having the tabs 13. As illustrated in FIG. 9 the top strip of tape may be grasped at the tab and lifted from the adjacent strips of tape, and in so doing the strip of tape engages the transverse edge 46, causing the cover 42 to bow intermediate its ends, as illustrated by the broken line in FIG. 9, restricting separation of the top strip of tape to an angle of substantially 90 degrees with respect to the top of the stack 44 of strips of tape through the separating movement.

In each embodiment the package is provided with a support member for supporting the stack of tape strips and a cover member defining means for restricting the peeling angle during dispensing of the top strip of tape to an angle more nearly 90 degrees than an angle of 180 degrees as is the case in separating the top strip of tape from a stack of strips without any flexible cover positioned over the stack of strips.

In a preferred embodiment the package strip is stamped from a strip of flexible polymeric material, e.g., high impact polystyrene sheet stock, having a thickness of between about 15 to 20 mils (0.015 to 0.020 inch), giving the support member considerably more rigidity or board than the stack of tape strips. This material is durable and printable and affords dispensing of the tape strip with a minimum amount of curl and is able to return to a near flat configuration. Other materials such as 16 point solid bleached sulphite (SBS), 9 point sulphite bond and a 24 point clay coated jute filled kraft backed stock are examples of paperboard materials useable. Polymeric materials such as 10 mil (0.010 inch) polyester and 20 mil (0.020 inch) ridged polyvinyl chloride are other examples.

Figure 10:
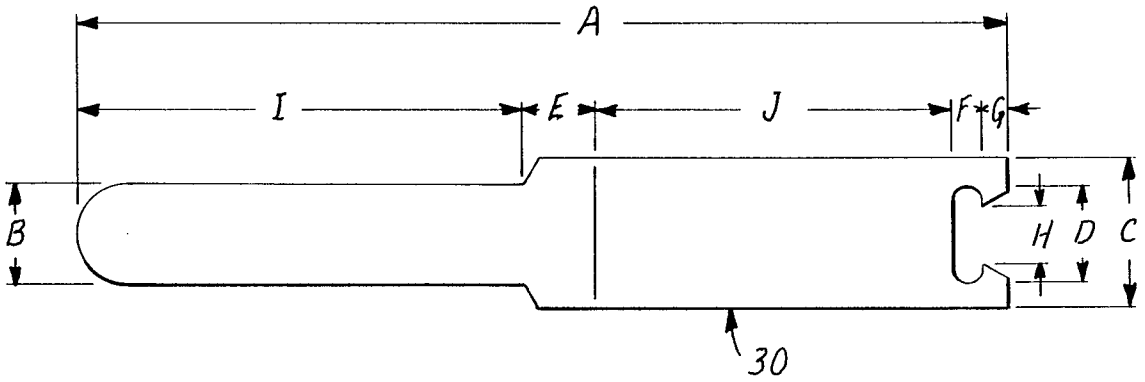
FIG. 10 is a view corresponding to FIG. 6 illustrating areas of a dispenser dimensionally.

As indicated in FIG. 10, the size of the blank for the dispenser for a stack of tape having a length L and width W is given in the following example.

Overall length $A=2\ L+2\ \frac{1}{8}$ inches
Width of tape support $B=W+\frac{1}{8}$ inch
Width of flap $C=W+\frac{5}{8}$ inch
Width of transverse edge $D=W+3/16$ inch Length of transition area $E=\frac{5}{8}''$ and may vary for stacks thicker than $\frac{1}{8}$ inch.
Length of support surface $I=L+9/16$ inch
Length of flap or cover $J=L+\frac{3}{8}$ inch
The width of the notch forming edge 36 $F=5/16$ and may vary for stacks of tape exceeding $\frac{1}{8}$ inch.
The width of hooks 37 $G=\frac{1}{4}$ inch.

In a specific example for a $\frac{1}{8}$ inch stack of tape 11, $\frac{3}{4}$ inch wide and 3 inches long, the dispenser has the following dimensions:

| | | |
|---|---|---|
| $A = 8\frac{1}{8}''$ | $B = \frac{7}{8}''$ | $C = 1\frac{3}{8}''$ |
| $D = 15/16''$ | $E = \frac{5}{8}''$ | $F = 5/16''$ |
| $G = \frac{1}{4}''$ | $H = \frac{3}{8}''$ | $I = 3\ 9/16''$ |
| $J = 3\frac{3}{8}''$ | | |

The transverse edge of the cover is generally normal to the tape or perpendicular to the axis of the package strip but it may be oblique to facilitate the dispensing and the need for two hooks to hold the cover.

The support members may be made of a flexible or rigid material. If formed of flexible material it may be formed with upturned side edges to afford beam strength and make the same rigid to stay planar. These side edges would also protect the sides of the tape stack. Further, as has been illustrated, the cover can be joined to one end of the support member by gluing; stapling; heat, solvent or ultrasonic bonding; or other means such that a compound curve or bow is formed in the cover during the dispensing. The cover however will bend into a bow as the tape strip is peeled off driving the transverse edge from adjacent the tabs to the opposite end of the stack.

Figure 11:
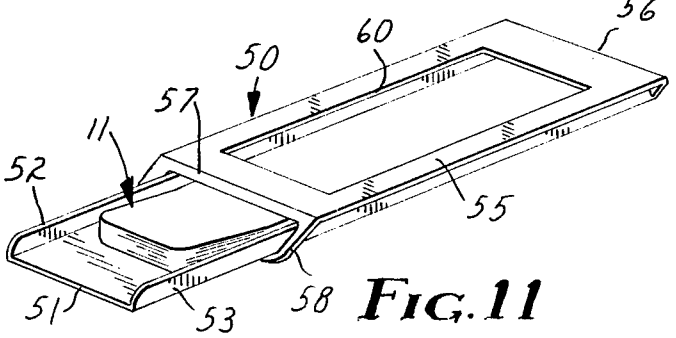
FIG. 11 is a perspective view of a tape package according to the present invention incorporating some modifications.

As illustrated in FIG. 11, the dispenser package 50 has a support member 51 formed with upwardly formed edge walls 52 and 53 which extend the length of the support member 51. A stack of tape 11 is placed on the supporting surface between the edge walls. A cover portion 55 is attached at one end 56 to the support member 51 and has a transverse edge 57 disposed across the stack of tape 11. Means 58 are provided to restrict separation of the edge from the top of the stack of tape 11 and the free edges of the walls 52 and 53. An elongate opening 60 may also be formed in the cover 55 to permit access to the tape in the stack to allow writings to be made onto the tape strips before they are dispensed from the stack, for labeling etc.

Having thus described the present invention with respect to a preferred embodiment and several alternative embodiments it is to be understood that further changes may be made without departing from the spirit or scope of the invention as defined by the appended claims.

We claim:

1. A tape package for use in carrying and dispensing strips of pressure-sensitive adhesive tape, said package comprising:

a stack of strips of pressure-sensitive adhesive tape, each strip having a backing with a coating of pressure-sensitive adhesive on one surface and a tab at one end, said strips being disposed in the stack with the coating of pressure-sensitive adhesive on one strip in contact with the backing of the adjacent strip and the tabs of said strips being disposed at one end of said stack, a support for the stack of strips having a support surface supporting the bottom strip of the stack of strips throughout the length of said bottom strip, a cover positioned over the surface of said stack of strips opposite the support surface and having a transverse edge positioned over and transverse to said stack of strips and adjacent said one end of the top strip of tape, said cover being joined to said support at the end opposite said transverse edge and being formed of flexible material such that said cover will bow between said edge and said opposite end during the dispensing of a strip of tape and will have sufficient memory to return to a position parallel to the stack of strips upon dispensing the top strip, and means for restricting separation of said transverse edge from said position over and transverse to said stack during said dispensing of one strip of tape from the stack.

2. A tape package according to claim 1 wherein said means includes an extended end on said cover which extends from at least one end of the transverse edge outwardly thereof and inwardly to form a member engaging the surface of said support opposite said support surface.

3. A tape package according to claim 1 wherein said means comprises an extended end on said cover which is formed to extend transversely of said cover and beyond said transverse edge to engage a surface of the support opposite said stack of strips.

4. A tape package according to claim 1 wherein said means comprises a free end on said cover which free end is formed with a transverse slot having one edge of the slot defining said transverse edge and the edge of the slot opposite said transverse edge engaging the surface of said support opposite said stack to restrict separation of said transverse edge from said position over the stack.

5. A tape package according to claim 1 wherein said support is provided with side walls projecting from opposite sides of the support surface to protect the sides of the stack of strips.

6. A tape package according to claim 1 wherein said support is formed with upturned edges adjacent the support surface and said means for restricting is adjacent said transverse edge and restricts separation of said transverse edge from the position over said stack and said upturned edges during dispensing of a strip from a said stack.

7. A tape package according to claim 7 wherein said means comprises a member extending from at least one edge of said transverse edge to a posistion to engage the support on the surface opposite said support surface.

8. A tape package according to claim 1 wherein an opening is formed in said cover to expose a surface of the strip of tape in the stack of strips for permitting writing on said strip.

* * * * *